US005582113A

United States Patent [19]

Langenbeck

[11] Patent Number: 5,582,113

[45] Date of Patent: Dec. 10, 1996

[54] MODULAR PALLET

[76] Inventor: Keith A. Langenbeck, 4005 University Blvd., Dallas, Tex. 75205

[21] Appl. No.: 322,562

[22] Filed: Oct. 13, 1994

[51] Int. Cl.[6] ..... B65D 19/00

[52] U.S. Cl. ..... 108/51.1; 108/56.1

[58] Field of Search ..... 108/51.1, 56.1, 108/56.3, 54.1, 901, 902

[56] References Cited

U.S. PATENT DOCUMENTS

| | | | |
|---|---|---|---|
| 2,699,912 | 1/1955 | Cushman | 108/56.1 |
| 2,973,931 | 3/1961 | Brown | 108/56.1 X |
| 3,307,504 | 3/1967 | Cloyd et al. | 108/56.1 |
| 3,824,933 | 7/1974 | Lind | 108/56.1 |
| 4,013,021 | 3/1977 | Steinlein et al. | 108/51.1 |
| 4,095,769 | 6/1978 | Fengels | 108/54.1 X |
| 5,007,352 | 4/1991 | Calkoen | 108/56.1 |
| 5,105,746 | 4/1992 | Reynolds | 108/56.1 |
| 5,197,395 | 3/1993 | Pigott et al. | 108/56.1 |
| 5,201,631 | 4/1993 | Ringot et al. | 108/51.1 X |
| 5,267,516 | 12/1993 | Abrahamson et al. | 108/51.1 |

*Primary Examiner*—Jose V. Chen
*Attorney, Agent, or Firm*—Michael E. Martin

[57] ABSTRACT

A modular pallet is made up of plural injection molded plastic pallet members, each of which has a plurality of posts spaced apart from each other and depending from a deck portion of the pallet member. The pallet members may be rectangular, square or of irregular shape but operable to provide either a square or rectangular shaped pallet when arranged in predetermined patterns in opposing deck sections of the pallet. The pallet members have cooperating projections and recesses formed in respective ones of the posts and the pallet members of one deck section overlie and interlock with at least two pallet members of the other deck section. Releasable fasteners comprising deflectable tines may be projected through openings in the cooperating projections and recesses of each pallet member to secure the pallet members of the opposing deck sections to each other to form the assembled modular pallet. The pallets may be square or rectangular and made up of plural identical pallet members in each deck section or no more than two different pallet members used to form a deck section.

17 Claims, 11 Drawing Sheets

MODULAR PALLET

FIELD OF THE INVENTION

The present invention relates to a material handling pallet made up of a plurality of interconnected members which may be formed of injection molded plastic.

1. Background of the Invention

Pallets for handling, storing and shipping are ubiquitous in the material handling art. Fabricated wood pallets are widely used and are annually produced in substantial numbers. However, wood pallets are unduly heavy, absorb and retain moisture, may not be easily repaired and have a relatively short working life. Accordingly, there has been a continuing need to develop pallets which overcome the disadvantages of wood pallets. In the beverage production industry, for example, there has been a need for a reusable pallet which is durable, lightweight, easily repairable and of moderate to low cost. It is to these ends that the present invention has been developed.

2. Description of the Prior Art

As mentioned above, wood pallets are widely used in material handling. In addition to the undesirable features of wood pallets such as heavy weight and difficulty of repair, most types of wood pallets are also not adapted to be picked up by forklift type equipment from any side of the pallet.

Various efforts have been made to overcome the disadvantages of wood pallets such as the development of molded plastic pallets which are formed in one piece or of two relatively large deck pieces. One type of molded plastic pallet uses opposed one-piece decks which are interconnected by a plurality of connector elements to form the pallet assembly. One disadvantage of this type of pallet is that, if one or two corners of the pallet are damaged, for example, it is expensive to repair. Shipping pallets are particularly subject to damage to the corners of the pallet due to unavoidable rough handling.

Another disadvantage of plastic pallets which are molded in one piece or have one-piece deck members is that the mold required to produce the pallet or pallet decks of injection molded plastic, in particular, is quite expensive to provide. The cost of molding equipment required to injection mold a part which may be at least three feet by three feet square, or greater in size, may be prohibitive. Accordingly, there is a strong desire to minimize the size of the pallet parts or members if they are to be formed of injection molded plastic.

Another type of plastic pallet has been developed wherein the pallet is made up of members which are substantially like wood pallet members, but are formed of molded plastic. These pallets typically include plural spaced-apart beams which are interconnected by transversely extending deck members. This type of pallet has the disadvantage of being made up of a plurality of several different types of members and is also relatively difficult to repair.

SUMMARY OF THE INVENTION

The present invention provides an improved material handling pallet which is of modular construction, may be made of molded plastic, may be more easily handled by material-handling equipment, such as forklifts, is lightweight and durable and may be easily repaired.

In accordance with an important aspect of the invention a pallet is provided which is made up of a plurality of members which are each provided with cooperating elements which allow the members to be interconnected to form a pallet having opposed deck sections. In one embodiment of the invention, each of the modular members is provided with plural spaced-apart projections and recesses which are cooperable with the projections and recesses of at least two other opposed members to form a rigid pallet assembly. The plural modular members are arranged in predetermined arrays and may be rigidly interlocked to form a strong, lightweight pallet which may be easily repaired and may be more easily handled than conventional pallets.

In accordance with another important aspect of the present invention, a pallet is provided which is made up of a plurality of identical members which are arranged in opposed arrays to form top and bottom decks of the pallet. The members substantially overlap each other in the respective arrays and are secured together to form a substantially rigid pallet assembly. The pallet members are easily fabricated of injection molded plastic, are small enough to be easily molded by relatively inexpensive molding equipment but are configured such that they may be easily assembled to provide so-called standard size pallets.

In accordance with yet a further aspect of the present invention, a modular pallet is provided which may be square or rectangular and made up of a plurality of identical members. A square pallet, for example, may be made up of eight identical members which are arranged in two arrays to form opposed decks of the pallets, which decks are interconnected by respective projections and recesses on each of the pallet members and the two decks are easily locked together by suitable releasable fasteners. In this way, any one of the pallet members may be replaced, if damaged, without replacing the entire pallet.

In accordance with still a further aspect of the present invention, a pallet is provided which may be rectangular in shape and may be made up of plural identical modular pallet members or sets of two pallet members which are not identical but which may be arranged in the aforementioned arrays to form opposed deck sections which are interconnected to form a rigid, lightweight and durable pallet.

Those skilled in the art will further appreciate the above-mentioned features and advantages of the invention together with other superior aspects thereof upon reading the detailed description which follows in conjunction with the drawing.

DESCRIPTION OF THE PREFERRED EMBODIMENTS

Figure 1:
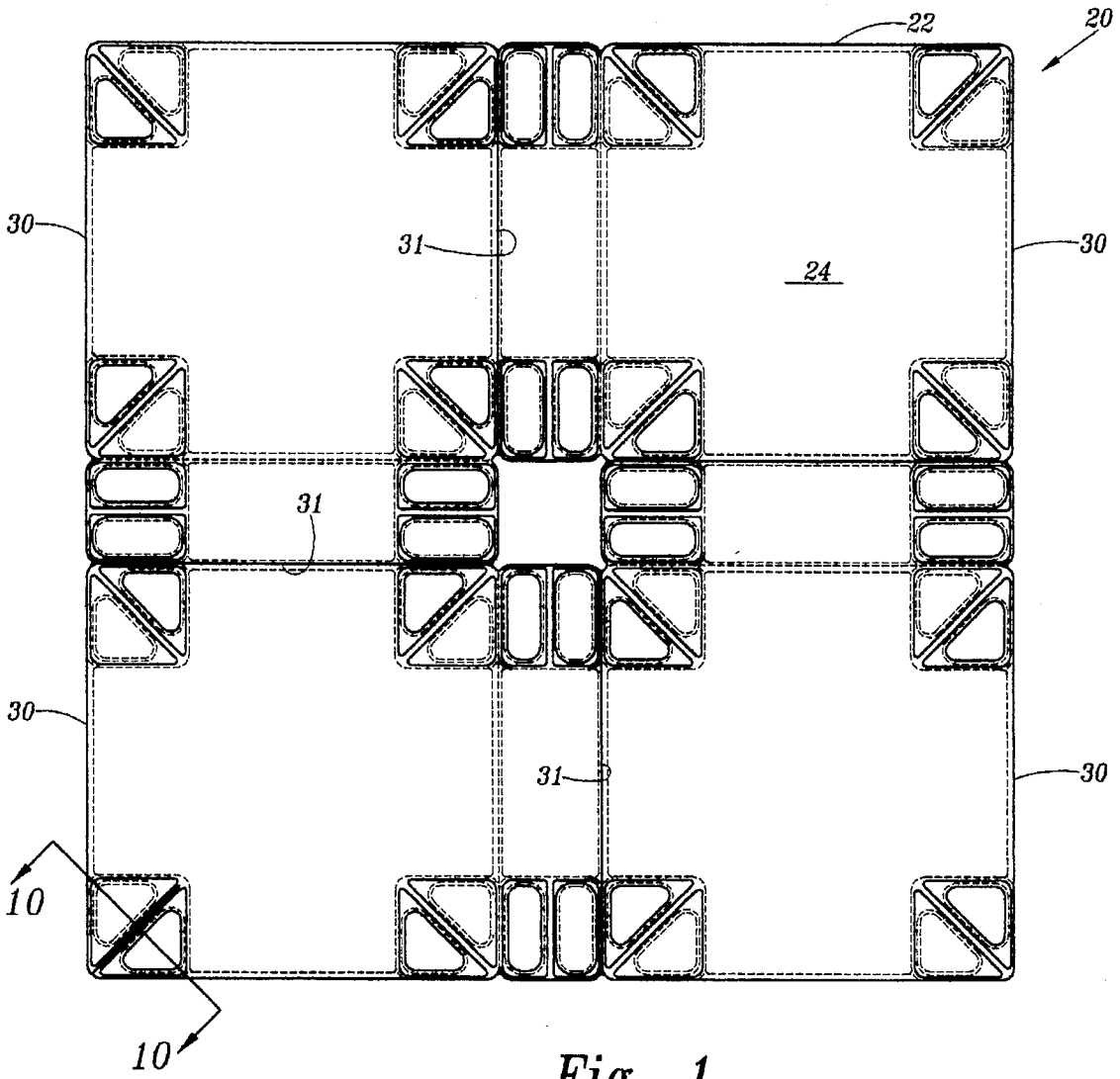
FIG. 1 is a plan view of a modular pallet in accordance with the present invention.

In the description which follows like parts are marked throughout the specification and drawing with the same reference numerals, respectively. The drawings are not necessarily to scale. Certain features of the invention are shown in somewhat generalized form in the interest of clarity and conciseness.

Referring to FIG. 1, there is illustrated a unique modular, material handling pallet in accordance with the invention and generally designated by the numeral 20. The pallet 20 is of generally square configuration in plan view and may be of a so-called standard size, such as three feet by three feet or four feet by four feet, as generally used in the storing and transporting bottled or canned beverages, for example. For purposes of illustration and discussion, and referring also to FIG. 2, the pallet 20 has a top deck section 22 with a generally planar support surface 24 formed thereon and a bottom deck section 26 having a planar support surface 28 formed thereon. Both deck sections 22 and 26 are made up of a plurality of substantially identical, modular pallet members 30 which are generally rectangular in shape and will be described in further detail in conjunction with FIGS. 4 through 9, in particular.

The members 30 making up the deck section 22 are not secured to each other to form the deck section as a rigid assembly. In like manner the members 30 making up the deck section 26 are also not secured to each other to make the deck section 26 a rigid assembly. However, when the members 30 making up the deck section 22 are laid over the deck section 26 they are operable to engage the members of the other deck section, due to their rectangular configuration, so that a substantially rigid assembly of eight of members 30, four in each deck section, forms a pallet 20. For purposes of illustration, one end wall 31 of each of the members 30 is identified in drawing FIGS. 1 through 3. Each of the members 30 of the deck section 22 overlies or overlaps two of the members 30 of the deck section 26 and vice versa. The end walls 31 of the members 30 of deck section 26 are shown by hidden lines in FIG. 1 and are indicated by the appropriate reference numerals.

Figure 4:
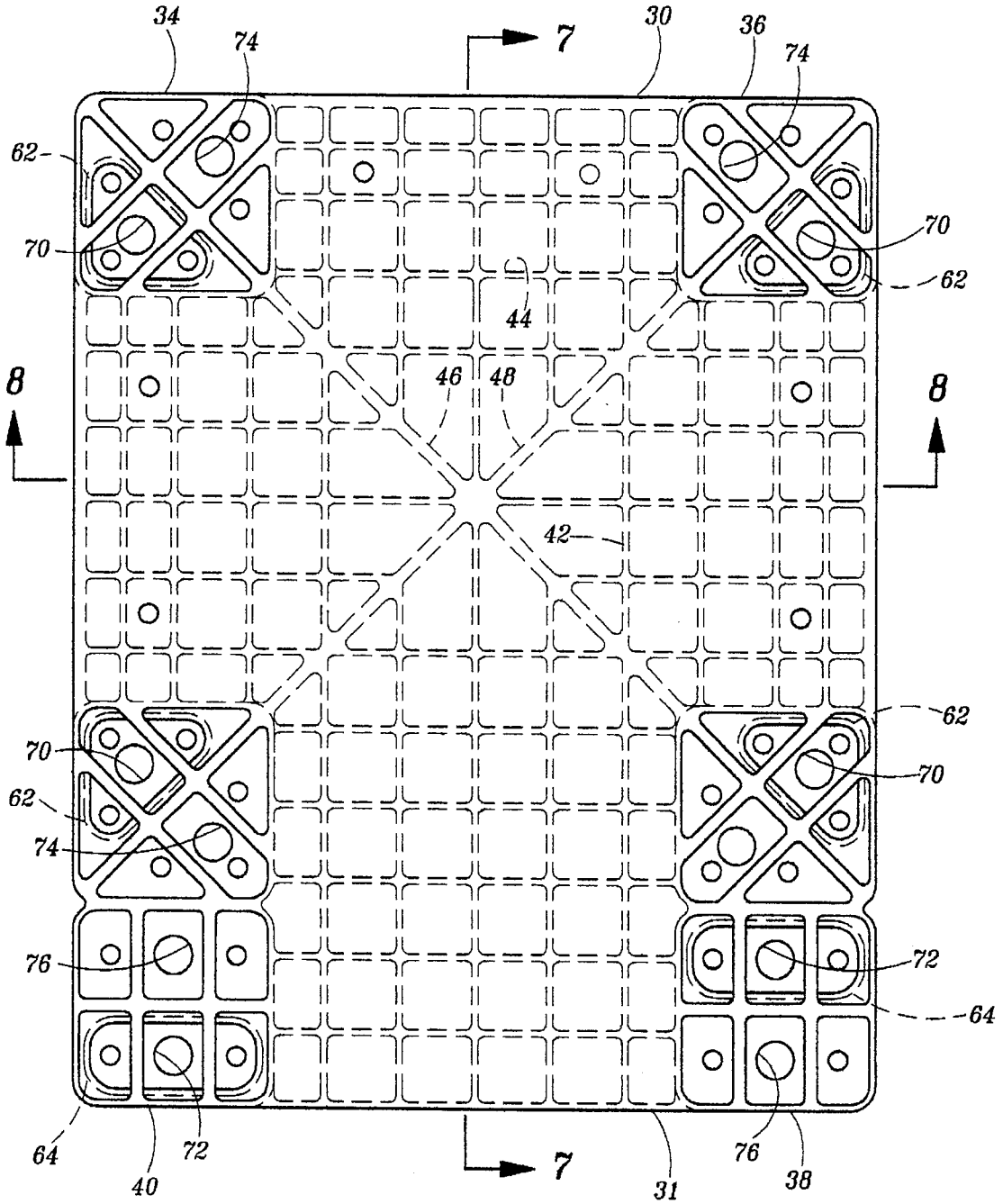
FIG. 4 is a top plan view of one of the modular pallet members of the embodiment of FIG. 1.
Figure 5:
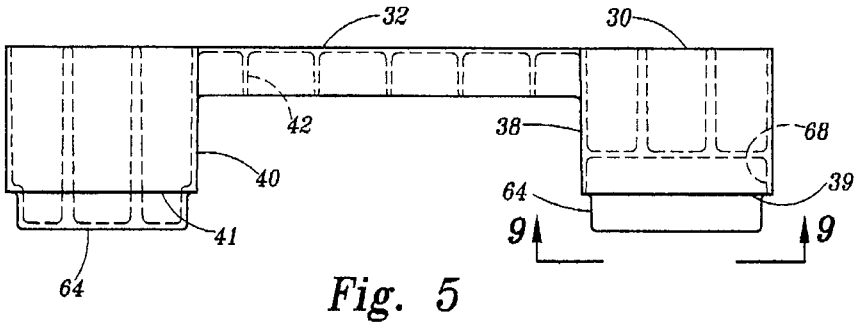
FIG. 5 is an end elevation of the pallet member shown in FIG. 4.
Figure 6:
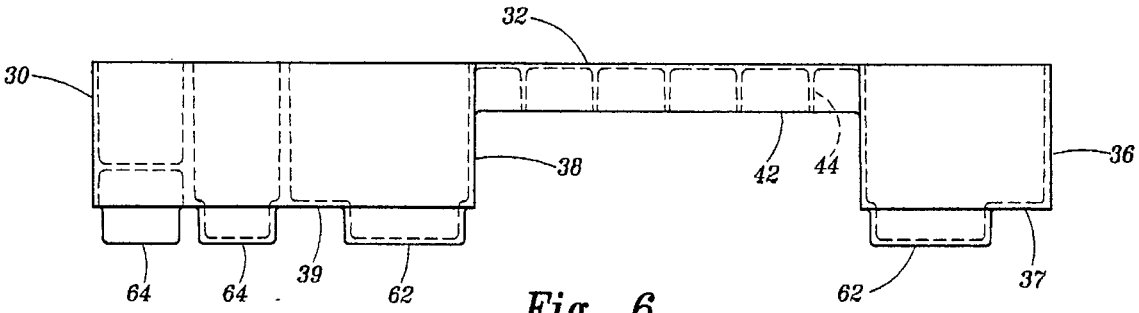
FIG. 6 is a side elevation of the pallet member of FIG. 4.

A modular pallet member 30 will now be described in detail in conjunction with FIGS. 4 through 9. Referring to FIGS. 4, 5 and 6, each of the pallet members 30 is characterized by a plastic injection molded member of generally rectangular shape having a major axis substantially coinciding with the section line 7—7 and a minor axis substantially coinciding with the section line 8—8 of FIG. 4. When the pallet members 30 are assembled to form the pallet 20 the major axis of each pallet member is parallel to the major axis of one opposing pallet member and the minor axis of the other opposing pallet member to which it is coupled, respectively. A generally planar deck 32 is formed on each member 30 together with spaced apart column portions or posts disposed at each corner of the member and designated by the numerals 34, 36, 38 and 40, respectively. The posts 34, 36, 38 and 40 depend from the deck 32, are generally hollow and may include suitable reinforcing ribs extending both diagonally and longitudinally thereacross, as indicated in FIG. 4. Moreover, the entire deck 32 of each member 30 is reinforced by a web of integral, longitudinal and transverse ribs 42 and 44, FIGS. 4, 7 and 8, the outermost ribs 42 and 44 forming generally vertical side and end walls, respectively, of the member 30.

Figure 2:
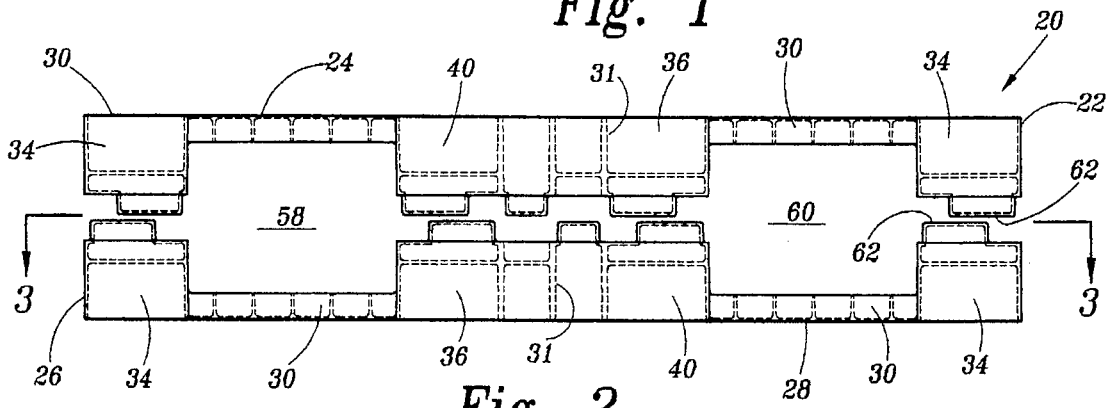
FIG. 2 is an exploded side elevation of the pallet of FIG. 1 with the opposed deck sections shown slightly separated.
Figure 3:
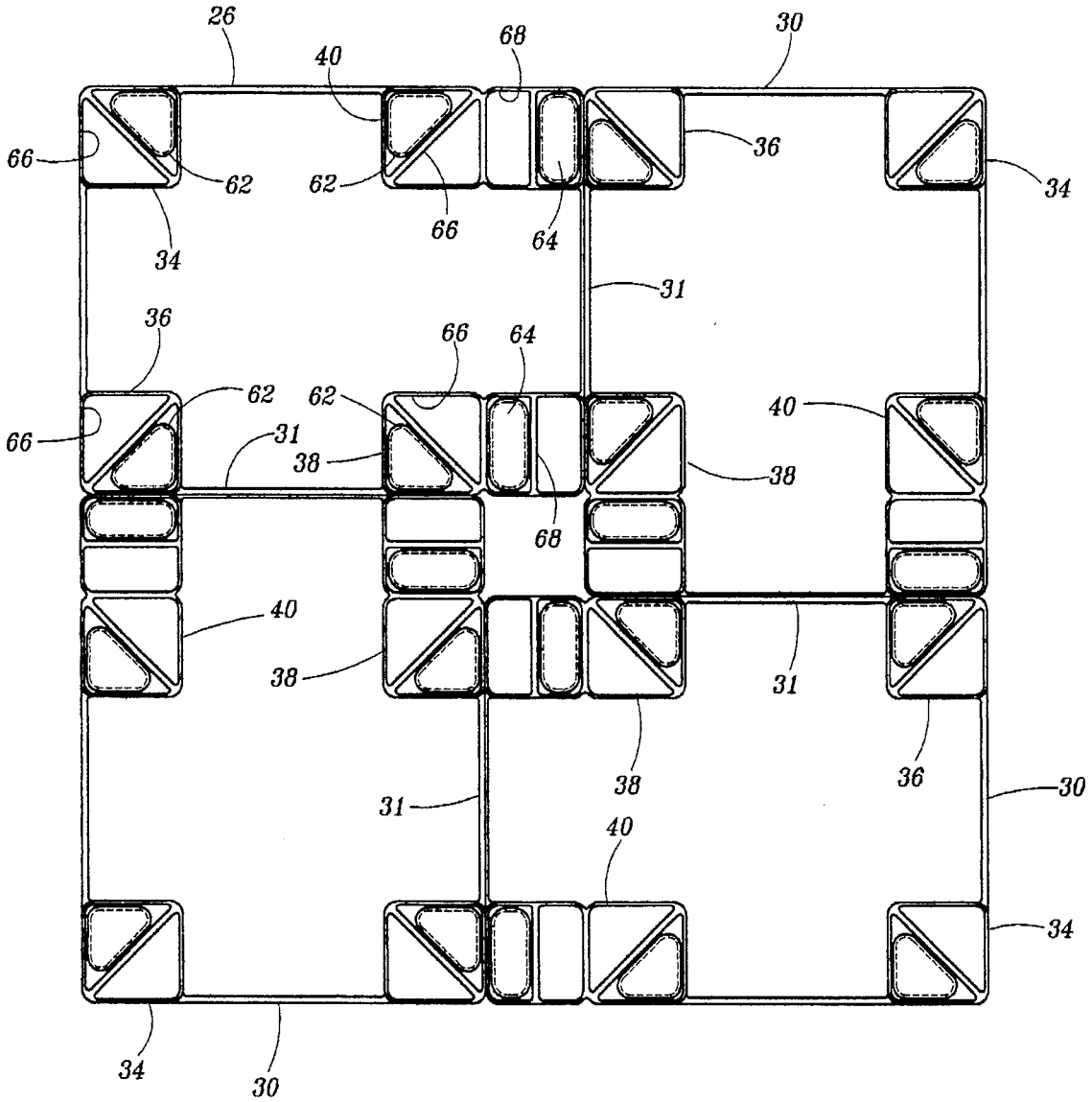
FIG. 3 is a plan view of a lower deck section, taken substantially from the line 3—3 of FIG. 2.
Figure 7:
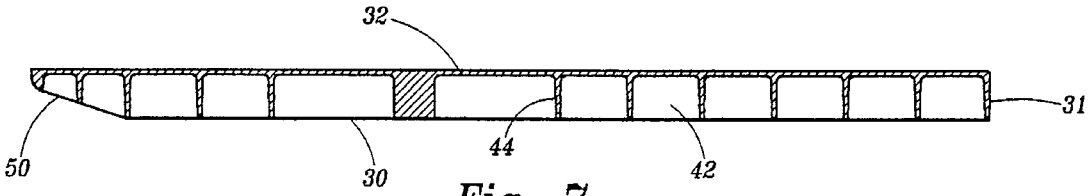
FIG. 7 is a section view taken along the line 7—7 of FIG. 4.
Figure 8:
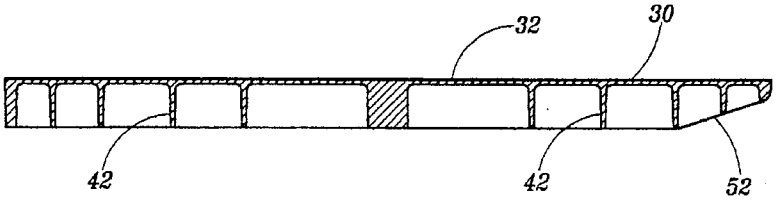
FIG. 8 is a section view taken along the line 8—8 of FIG. 4.

As shown in FIG. 4, diagonal ribs 46 and 48 extend between the posts 34 and 38 and the posts 40 and 36, respectively. The ribs 46 and 48 are preferably of greater thickness than the ribs 42 and 44 and not only give additional strength to the member 30 but serve as flow channels for conveying molten plastic material in a more effective manner into the portions of a mold, not shown, for the member which defines the ribs 42 and 44. FIG. 7 illustrates a beveled edge 50 and FIG. 8 illustrates a beveled edge 52 of the member 30, which edges, when the members 30 are assembled into a pallet 20, provide easy access to the pallet by the tines of a forklift, for example, not shown. As illustrated in FIG. 2, the opposed posts 34, 36, 38 and 40 provide respective openings 58 and 60, for example, which provide for receiving the tines of a forklift to lift the pallet 20 in a conventional manner and from any side of the pallet 20.

Figure 9:
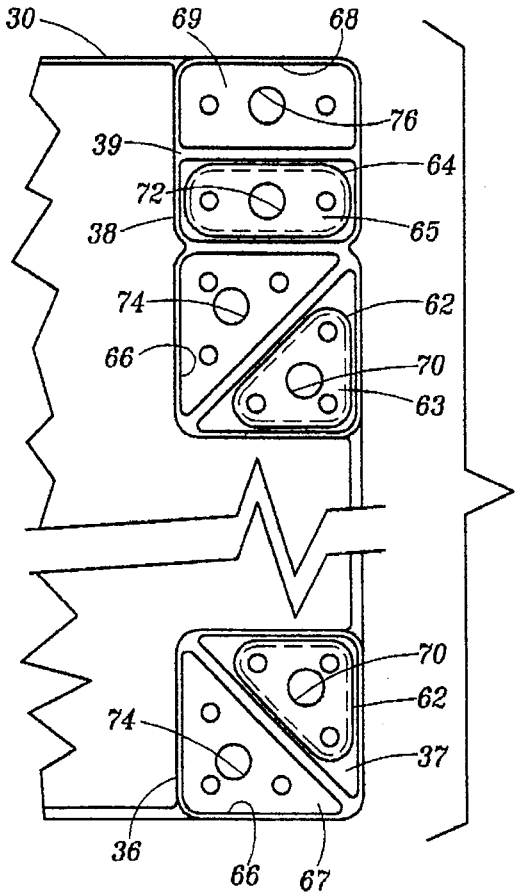
FIG. 9 is a detail plan view of the posts and associated projections and recesses along one side of the pallet member of FIG. 4 and taken generally from the line 9—9 of FIG. 5.

Referring again to FIGS. 4, 5, and 6, the posts 34, 36, 38 and 40 are provided with respective integral plugs or projections 62 and 64, as illustrated, which project from coplanar surfaces formed by transverse peripheral shoulders or edges of the posts 34, 36, 38 and 40 which are parallel to the deck portion 32. The edges on posts 36, 38 and 40 are designated by numerals 37, 39, and 41 in FIGS. 5 and 6. A similar coplanar edge 35 is provided for the post 34, FIG. 10. The projections 62 are generally triangular in configuration as indicated in FIGS. 4 and 9, and the projections 64 are generally oval or oblong as also indicated in FIGS. 4 and 9. The integral posts 38 and 40 include sets of adjacent projections 62 and 64, respectively. However, the projections 64 and associated recesses described herein below may be disposed on separate posts, not shown.

A generally triangular shaped recess 66 is formed in each of the posts 34, 36, 38 and 40 adjacent each of the projections 62. Moreover, each of the posts 38 and 40 also has a somewhat oblong or rectangular recess 68 formed therein. The sidewalls of the posts defining the recesses 66 and 68 are spaced apart such that the recesses are operable to receive the projections 62 and 64, respectively, of mating opposed pallet members 30 when the pallet members are arranged relative to each other in the patterns indicated FIGS. 1 through 3. Thanks to the arrangement of the cooperating projections 62 and recesses 66 and the cooperating projections 64 and recesses 68, a substantially rigid modular pallet 20 is formed by the arrays of members 30 in the opposed deck sections 22 and 26. Each post of the pallet member 30 includes a depending projection 62 and an adjacent triangular shaped recess 66 opposed to the projection 62 and arranged in the pattern illustrated in FIGS. 4, 5, 6 and 9. Accordingly, in the arrangement of the posts 38 and 40 and the associated projections 64 and recesses 68, when the members 30 are assembled overlying each other in the patterns illustrated in FIGS. 1 through 3, the projections 64 of one member 30 are received in the recesses 68 of a member 30 which is overlying the first mentioned member.

In like manner, the projections 62 of the posts 34, 36, 38 and 40 of a member 30 in one deck section are received in cooperating recesses 66 of two adjacent members 30 in the other deck section. In this way, a rigid interlocking arrangement of the opposed deck sections 22 and 26 is provided. As shown in FIGS. 4 and 9, each of the posts 62 and 64 is provided with a suitable fastener receiving opening 70 and 72, respectively, formed in transverse bottom wall portions 63 and 65 of the respective posts. In like manner each Of the recesses 66 and 68 is provided with a fastener receiving opening 74 and 76 formed in respective transverse walls 67 and 69 of the recesses.

Figure 10:
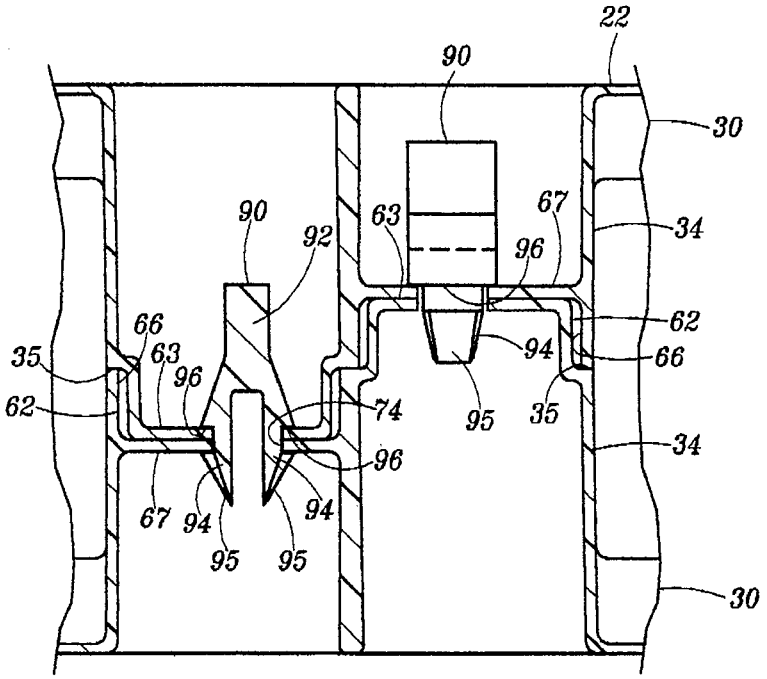
FIG. 10 is a detail section view taken from the line 10—10 of FIG. 1.

FIG. 10 illustrates how the opposed posts of respective members 30 engage each other. By way of example, two opposed members 30 of the respective deck sections 22 and 26 of the pallet 20 are shown wherein the posts 34 of the respective opposed members are in registration with each other so that the shoulders or edges 35 are inter-engaged and a projection 62 of one member 30 is in registration with and projects into a recess 66 of the other member 30. Accordingly, the fastener receiving openings 70 and 74 are aligned with each other for receiving a unique fastener 90. The fasteners 90 each include a shank 92 and opposed resiliently deflectable tines 94 projecting from the shank. The tines 94 are each provided with a transverse slot 96 which is dimensioned to have a width slightly greater than the thickness of the transverse walls 63 and 67 of the respective projections 62 and recesses 66. When the projections 62 are disposed in the cooperating recesses 66, the fasteners 90 may be projected through the openings 70 and 74 so that the tines 94 may spring back into the position shown in FIG. 10 and interlock the members 30 with each other. The tines 94 are conveniently provided with sloping cam surfaces 95, FIG. 10, to aid in driving the fasteners through the openings 70 and 74 and through the cooperating pairs of openings 72 and 76 for the respective projections 64 and recesses 68, also.

In this way, a unique, easily assembled pallet 20 may be provided by arranging the pattern of rectangular pallet members 30 in the respective deck sections 22 and 26, as shown and described. With the interengaging projections and recesses of each of the posts 34, 36, 38 and 40 in registration with each other, fasteners 90 may be driven through the cooperating pairs of fastener receiving openings 70 and 74 and 72 and 76, respectively, to couple the members 30 of each of the deck sections 22 and 26 to the cooperating members 30 of the other deck section. If it is desired to remove and replace one or more members 30 from the pallet 20, in the event of damage, a suitable tool may be provided to deflect the fastener tines 94 toward each other to permit removal of a fastener 90 from the fastener receiving openings of the cooperating projections and recesses, respectively.

As mentioned previously, the pallet members 30 may be injection molded of a suitable plastic such as a high density polyethylene, for example. Thanks to the unique configuration of the pallet members 30, a conventional size pallet, say three feet by three feet square or four feet by four feet square may be provided of molded plastic wherein a pallet may be easily repaired if only a portion is damaged and the pallet may be manufactured of modular members which are operable to be injection molded on conventional, low cost molding equipment. Since molding equipment is not required of a size which would be capable of molding the entire pallet 20 in one piece, or even two pieces, the cost of molding the pallet 20 is substantially reduced by fabricating the pallet 20 of plural molded pieces in each deck section and then securing the deck sections together in a rigid assembly. With the arrangement of the cooperating projections and recesses in each of the posts of the modular pallet members 30 and also the overlapping relationship of the respective rectangular pallet members, a pallet 20 may be formed of molded plastic which is reduced in cost and may be easily repaired. The posts 34, 36, 38 and 40 may also be formed separate from the members 30 wherein such modified posts could have opposed projections formed thereon and registerable with cooperating recesses formed on the opposed deck members or vice versa.

Figure 11:
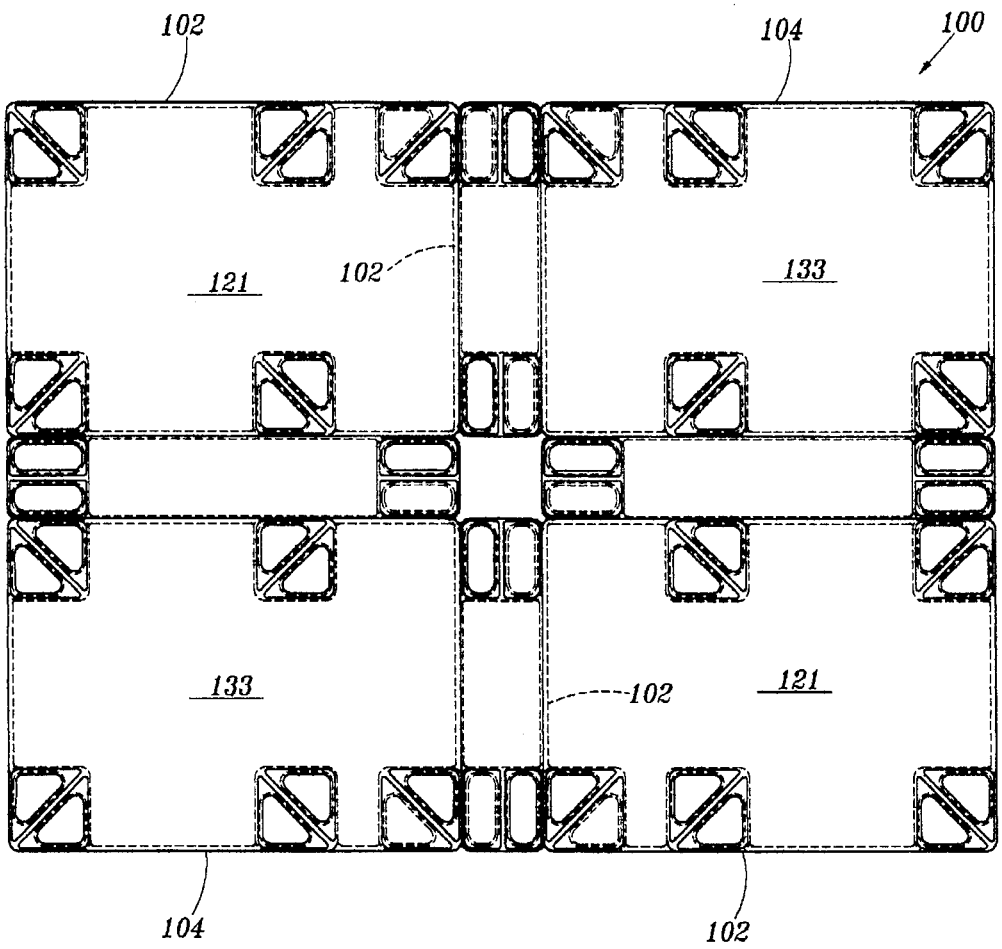
FIG. 11 is a plan view of a first alternate embodiment of a pallet in accordance with the present invention.
Figure 12:
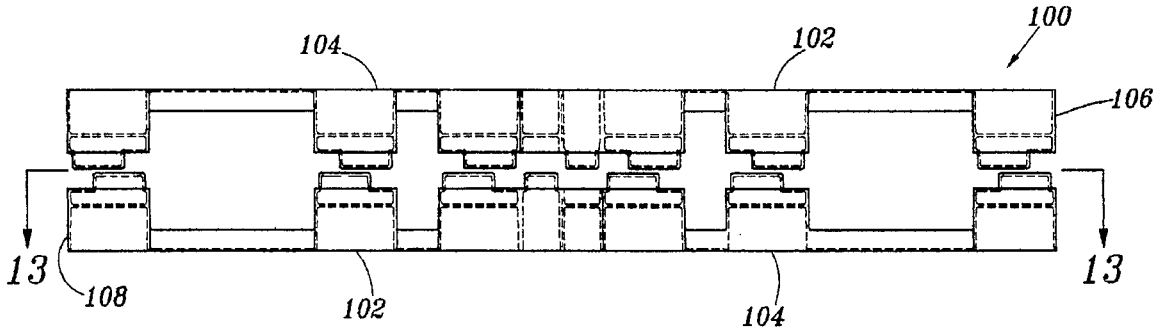
FIG. 12 is an exploded side elevation of the pallet of FIG. 11 showing the opposed deck sections slightly separated.
Figure 13:
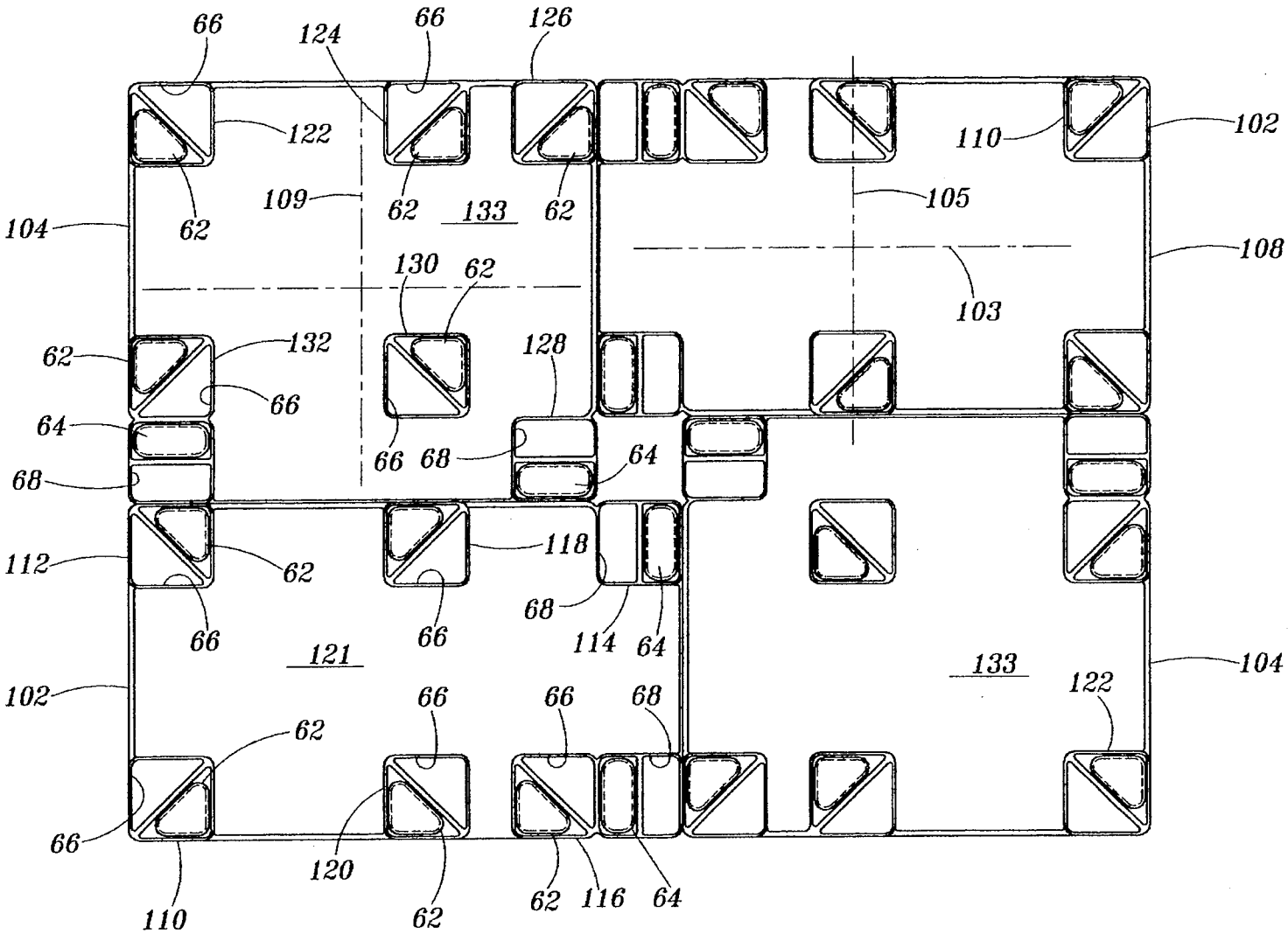
FIG. 13 is a plan view of the lower deck section taken from the line 13—13 of FIG. 12.

Referring now to FIGS. 11 through 13, an alternate embodiment of a modular pallet in accordance with the invention is illustrated and generally designated by the numeral 100. The pallet 100 is similar in some respects to the pallet 20 but is of generally rectangular configuration and is made up of respective molded plastic rectangular pallet members 102 and substantially square pallet members 104 arranged in opposed deck sections 106 and 108, FIG. 12. FIG. 13 shows the pattern of the members 102 and 104 for the deck section 108. Each pallet member 102 has major and minor axes 103 and 105, respectively. Each pallet member 104 has axes 109, normal to each other. As shown in FIG. 13, each member 102 is of generally rectangular configuration and has a similar pattern of spaced apart corner posts 110, 112, 114 and 116 and intermediate posts 118 and 120 extending normal to a planar deck portion 121. The posts 110, 112, 116, 118 and 120 are provided with projections 62 and recesses 66, as illustrated, while the posts 114 and 116 are also provided with the cooperating oblong projections 64 and recesses 68. In like manner the substantially square members 104 are provided with respective posts 122, 124, 126, 128, 130 and 132 extending normal to a planar deck portion 133. Respective sets of projections 62 and recesses 66 are provided on each of the posts 122, 124, 126, 130 and 132 and respective sets of projections 64 and recesses 68 are provided on the posts 128 and 132 as illustrated. When the members 102 and 104 of each deck section 106 and 108 are laid over the cooperating members 102 and 104 of the other deck section the projections 62 and 64 of each of the members 102 and 104 register with cooperating recesses 66 and 68 of the members of the other deck section, respectively, when the pallet members are arranged in the patterns illustrated in FIGS. 11, 12 and 13. The cooperating opposed pallet members 102 and 104 of the deck sections 106 and 108 may be secured to each other in the same manner as that described for the pallet 20 and illustrated in detail in FIGS. 9 and 10, for example.

Figure 14:
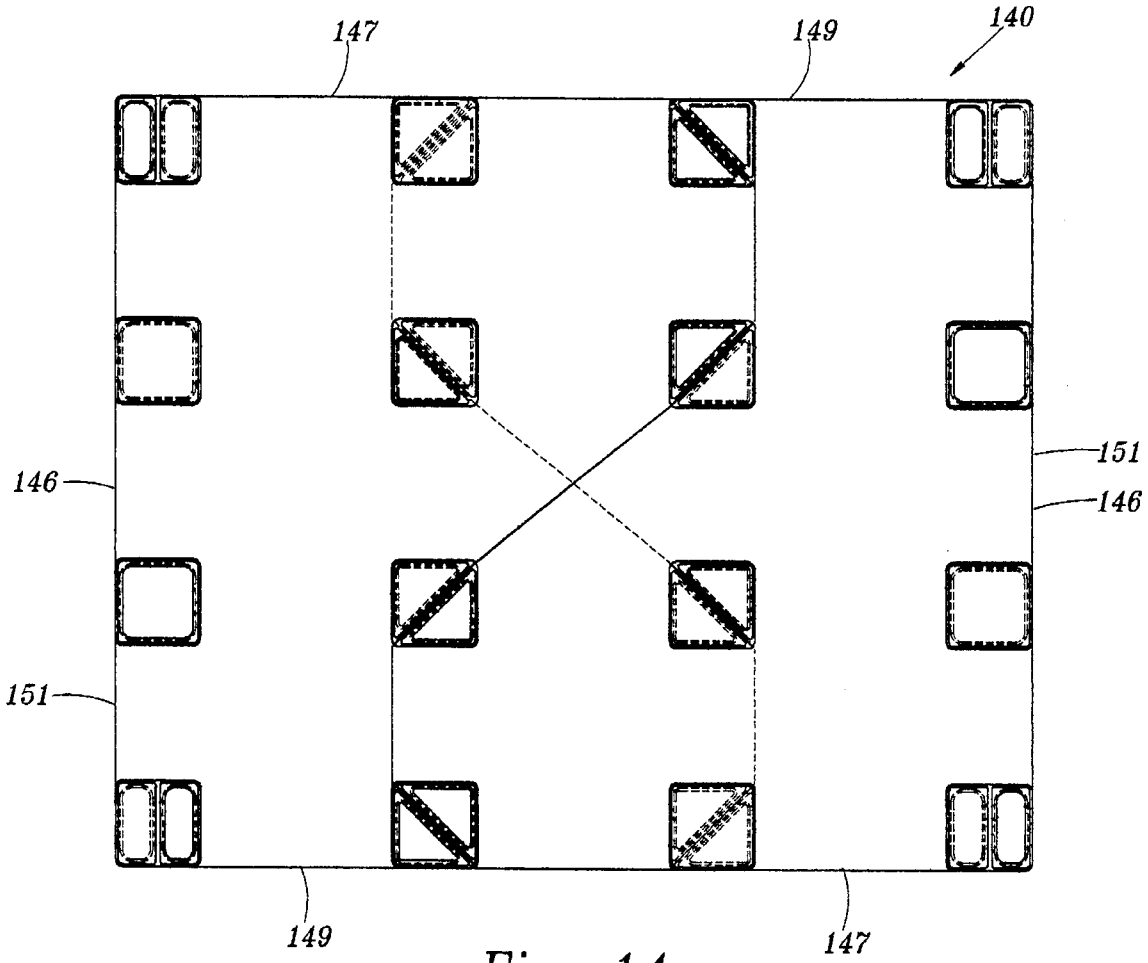
FIG. 14 is a plan view of a second alternate embodiment of a pallet in accordance with the invention.
Figure 15:
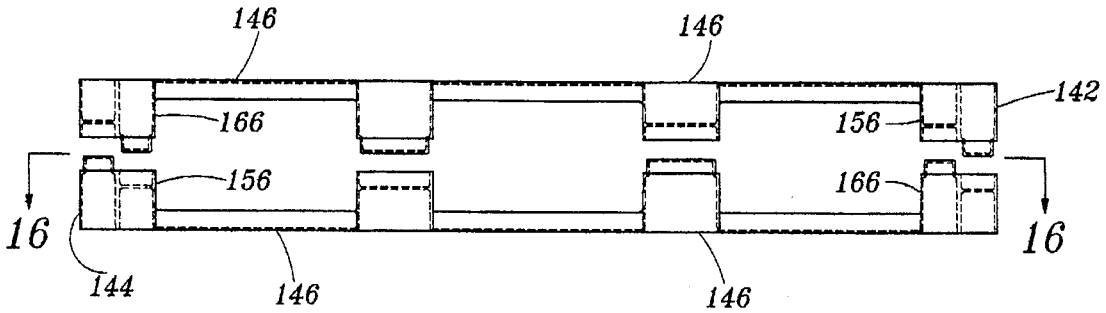
FIG. 15 is an exploded side elevation of the pallet of FIG. 14.
Figure 16:
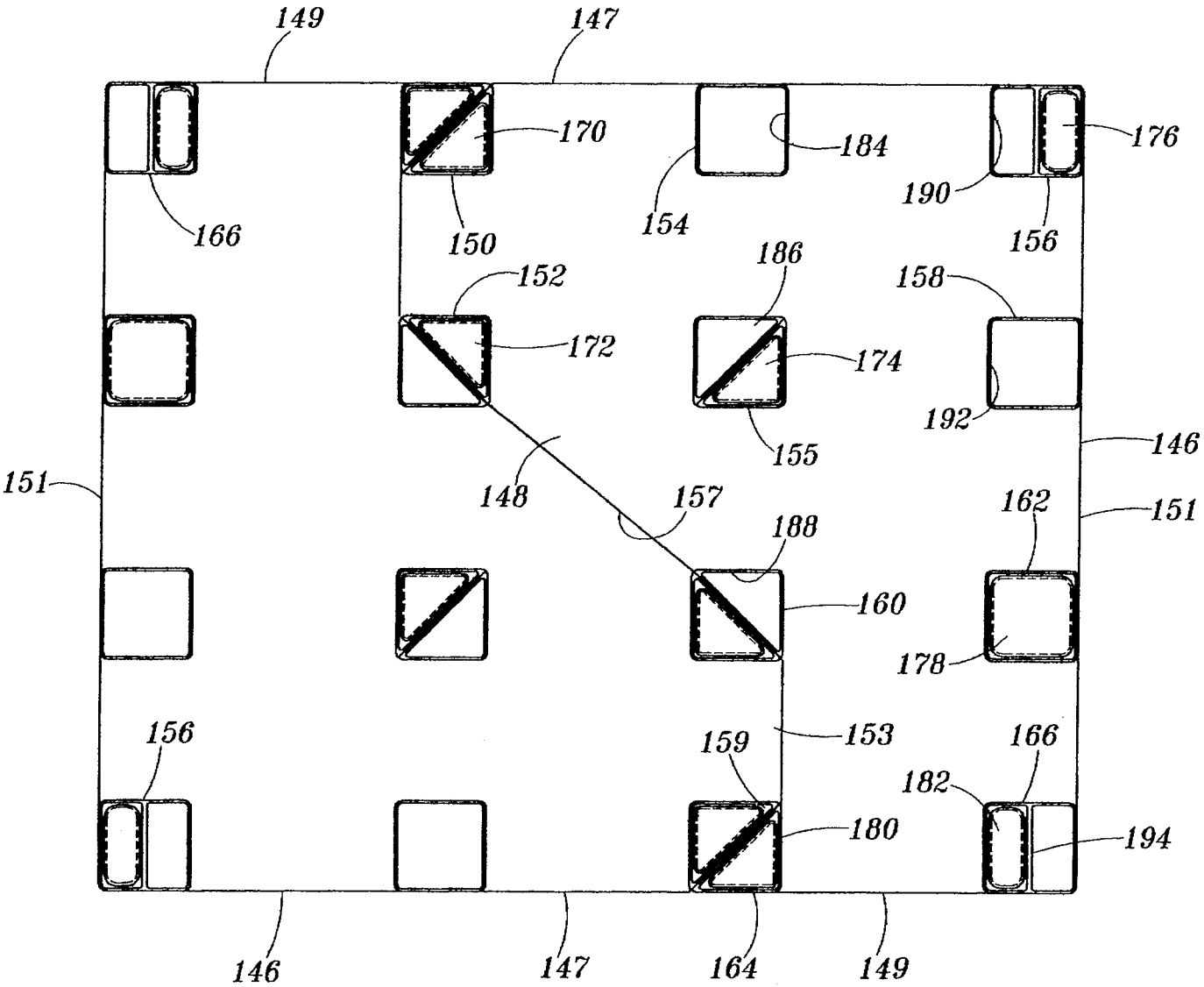
FIG. 16 is a view taken from line 16—16 of FIG. 15.

Referring now to FIGS. 14 through 16, a second alternate embodiment of a pallet in accordance with the present invention is illustrated and generally designated by the numeral 140. The pallet 140 is also of a generally rectangular configuration and is made up of opposed deck sections 142 and 144, each of which comprises two modular molded plastic pallet members 146 which are of identical configuration. Accordingly, the pallet 140 is made up of two pallet members 146 in the deck section 142 and two pallet members 146 in the deck section 144. Each of the pallet members 146, as shown in FIG. 16, includes a generally planar deck portion 148 and a plurality of transversely projecting posts or columned portions 150, 152, 154, 155, 156, 158, 160, 162, 164 and 166. By providing the members 146 to have opposed parallel side edges 147 and 149, opposed parallel side edges 151 and 153 and opposed diagonal edges 157, 159, and 161, the members 146 may be arranged interengaged with each other such that the pallet 140 is made up of only four identical members, each of which is in registration with two other members.

As shown in FIG. 16, the posts 150, 152, 155, 156, 162, 164 and 166 are provided with respective projections 170, 172, 174, 176, 178, 180 and 182 which are operable to register with recesses 184, 186, 188, 190, 192 and 194 in the respective posts of another member or members 146. The members 146 of each deck section 142 and 144 may be secured to the cooperating members of the other deck section in the same manner as provided for in the pallet 20. As will be appreciated by those skilled in the art, an important advantage of the pallet 140 is that it is made up of a plurality of identical pallet members 146 which may be arranged opposed to each other in the opposed deck sections 142 and 144.

Figure 17:
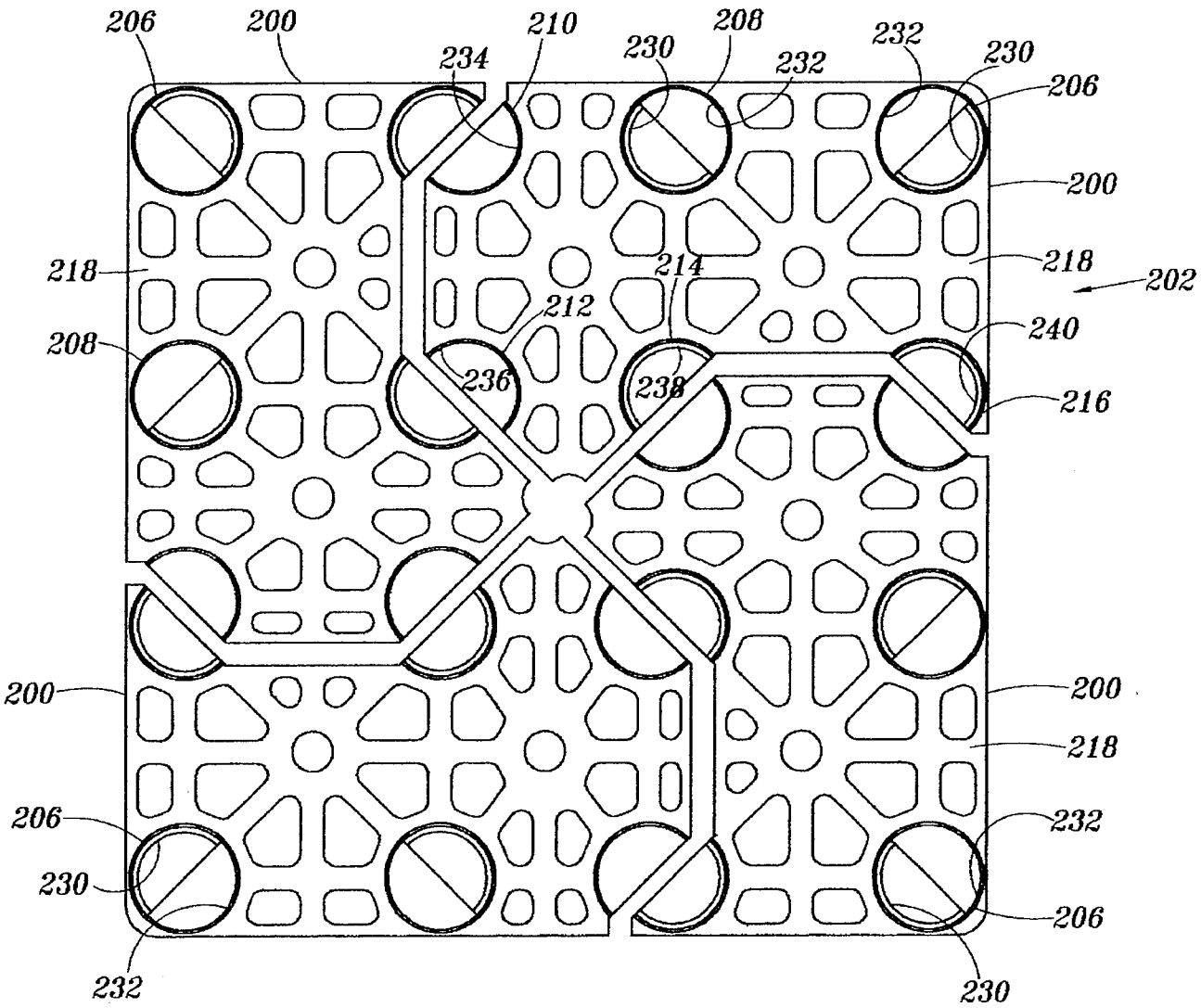
FIG. 17 is a plan view of a third alternate embodiment of a pallet in accordance with the invention showing the arrangement of the pallet members of one of the deck sections.
Figure 18:
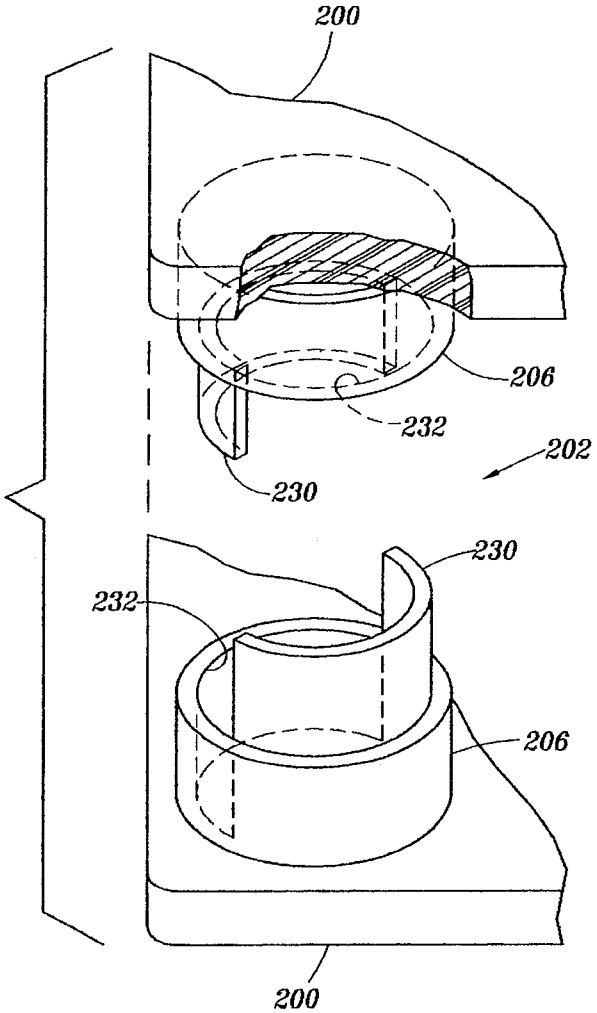
FIG. 18 is a detail view of the posts, projections and recesses of one of the pallet members of the embodiment shown in FIG. 17.

Referring now to FIGS. 17 and 18, there is illustrated an arrangement of molded plastic pallet members 200, wherein each member 200 is identical to the other member and four members may be used to make up a deck section 202 which can be opposed to a second deck section, not shown, to form a modular pallet similar to the pallets 20, 100, and 140. The pallet members 200 are each provided with plural, generally cylindrical posts 206, and 208 and generally half cylindrical posts 210, 212, 214, and 216 which depend from a deck portion 218 generally transversely thereof in a manner similar to the construction of the deck members 30, 102, 104 and 146. Each of the posts 206 and 208 is provided with a half cylindrical projection 230, as shown by way of example in FIG. 18, and an opposed half cylindrical recess 232. In like manner the posts 210 and 212 are provided with half cylindrical recesses 234 and 236 and the posts 214 and 216 are provided with half cylindrical projections 238 and 240, respectively. When the members 200 are assembled in opposed deck sections in the pattern illustrated in FIG. 17, the respective half cylindrical projections on the respective posts cooperate with the half cylindrical projections on the opposing posts to provide the interlocking relationship of the pallet members in a manner similar to that provided for the previous embodiments discussed hereinabove. Since each of the pallet members 200 of one deck section overlap two cooperating pallet members of the other deck section, the deck sections are in registration with each other at cooperating projections and recesses and are interengaged in substantially the same manner as for the previously discussed embodiments of the invention. The members 200 of each deck section of a pallet formed of these members may be secured to the opposing members by faster means similar to that described for the pallet 20.

Figure 19:
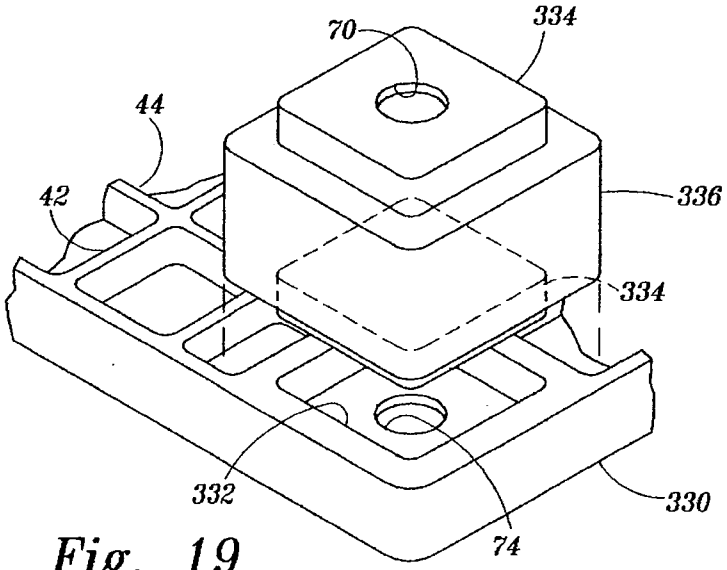
FIG. 19 is a detail perspective view of a fourth alternate embodiment of the invention.

Referring now to FIG. 19, there is illustrated a portion of a pallet member 330 similar to a pallet member 30, but having plural recesses 332, one shown, molded therein for receiving a projection 334 of a post 336 having opposed projections 334 formed thereon. Accordingly, a modular pallet may be made up of a plurality of opposed members 330 and separate spaced apart posts 336 which register with each member at those points where one member overlies another at aligned recesses 332. The members 330 and posts 336 may be secured to each other with fasteners 90 or a similar push in type fastener.

Figure 20:
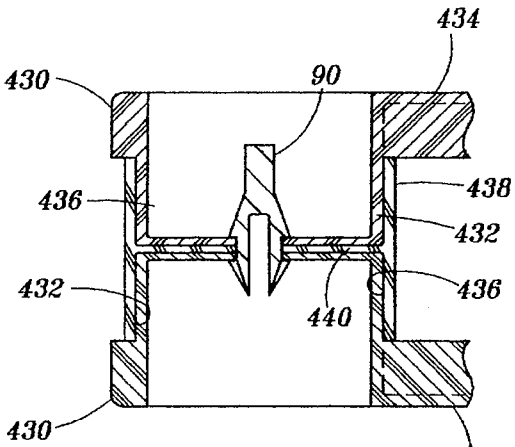
FIG. 20 is a detail section view of a fifth alternate embodiment of the invention.

Referring now to FIG. 20, there is illustrated a detail section view of an embodiment of the present invention wherein a pallet is made up of opposed modular pallet members 430 which may be configured generally like the pallet members 30 but are formed with respective spaced apart integral projections 432 which may be of generally square cross section, for example. The projections 432 extend normal to a deck portion 434 of the pallet member 430. The projections 432 are adapted to project into cooperating opposed recesses 436 formed in a cooperating post member 438 having a transverse center web 440 delimiting each of the recesses 436. As shown in FIG. 20, the projections 432 and the web 440 have suitable openings formed therein for receiving a fastener 90 adapted to interconnect the opposed pallet members 432 with each other and with the post member 438 interposed therebetween. The pallet members 434 are adapted to have the cooperating projections 432 disposed at least at each corner thereof or in a pattern similar to the pattern of projections 62 and 64 formed on the pallet member 30, for example.

The fabrication and assembly of the embodiments of the unique modular pallet of the present invention are believed to be within the purview of the art worker from the foregoing description. Conventional plastic injection molding techniques may be used to form the pallet members and fasteners, and the pallet members are preferably made from a high density polyethylene injection moldable plastic compound, as mentioned above. Each of the embodiments enjoys the advantages mentioned for the inventive pallet in that a lightweight, high strength, modular pallet may be formed from the overlapping interlocking pallet members arranged in opposed patterns of opposed deck sections and releasably fastenable to each other using the unique fastener described in conjunction with FIG. 10.

Although preferred embodiments of the invention have been discussed in detail herein, those skilled in the art will recognize that various substitutions and modifications may be made to the invention without departing from the scope and spirit of the appended claims.

What is claimed is:

1. A pallet comprising plural pallet members in each of two opposed first and second deck sections, said first deck section is defined by four substantially rectangular pallet members having respective major and minor axes and said second deck section is defined by four rectangular pallet members having respective major and minor axes;

each of said pallet members defining said first deck section is coupled to two of said pallet members defining said second deck section and in overlapping relationship therewith each of said pallet members defining said second deck section is coupled to two of said pallet members defining said first deck section and in overlapping relationship therewith; and wherein the major axis of each pallet member is parallel to the major axis of one of the pallet members to which it is coupled and a minor axis of the other pallet member to which it is coupled.

2. The pallet set forth in claim 1 wherein:

the major axis of each pallet member is parallel to the respective minor axes of two other pallet members of the same deck section and the major axis of one other pallet member of said same deck section.

3. The pallet set forth in claim 2 wherein:

said pallet members are identical and the pallet members of each deck section define a generally square-shaped deck section, each of said pallet members being adjacent two other pallet members of the same deck section and being diagonally opposite the remaining pallet member of said same deck section.

4. The pallet set forth in claim 1 including:

a plurality of posts extending between said deck sections and engaged with the pallet members of one of said deck sections, each of said posts including at least one of a projection and recess formed thereon and cooperating with a corresponding one of a recess and projection of an opposed pallet member of the other deck section.

5. The pallet set forth in claim 4 wherein:

said projections are triangular in cross section.

6. The pallet set forth in claim 4 wherein:

said projections are oblong in cross section.

7. The pallet set forth in claim 4 wherein:

said projections are square in cross section.

8. The pallet set forth in claim 4 wherein:

said projections are half cylindrical in cross section.

9. The pallet set forth in claim 4 including:

fastener means for releasably interconnecting one pallet member with an opposing pallet member.

10. The pallet set forth in claim 9 wherein:

said fastener means comprises a shank portion and opposed resiliently deflectable tines connected to said shank portion and said tines are adapted to be projected through respective openings formed in said pallet members in registration with each other to secure said pallet members to each other.

11. The pallet set forth in claim 10 wherein:

said openings in said pallet members are formed in said cooperating projections and recesses.

12. The pallet set forth in claim 1 wherein:

said pallet members are formed of molded plastic.

13. The pallet set forth in claim 1 wherein:

each pallet member has a planar deck portion with a plurality of posts projecting from said deck portion, said posts including surface means adapted to be in registration with corresponding surface means of opposing posts of an opposing pallet member to maintain said first and second deck sections in a predetermined spaced relationship.

14. The pallet set forth in claim 13 wherein:

each post has at least one projection and one recess formed therein, the projection portion of each post being operable to be in registration with the recess of a post of a cooperating pallet member and the recess formed in the first mentioned pallet member being in registration with a projection formed on the post of the cooperating pallet member.

15. The pallet set forth in claim 14 wherein:

a projection formed on a post is adjacent to a recess formed on said post.

16. The pallet set forth in claim 13 wherein:

said posts of said pallet member are integrally formed therewith.

17. A pallet comprising two opposed, generally square shaped deck sections, each of said deck sections being made up of four pallet members, each of said pallet members defining a corner of said deck section, each of said pallet members being adjacent to two other pallet members of the same deck section and being diagonally opposite the remaining pallet member of said same deck section, each of said pallet members defining one of said deck sections is coupled to two of said pallet members defining the other of said deck sections and in overlapping relationship therewith and each of said pallet members defining said other deck section is coupled to two of said pallet members defining said one deck section and in overlapping relationship therewith;

each of said pallet members including a deck portion and a plurality of posts projecting substantially normal to said deck portion, each of said posts including at least one of a projection and recess formed thereon and cooperating with a corresponding one of a recess and projection of an opposed pallet member of the opposed deck section; and plural fastener members operable to releasably interconnect said deck sections at selected ones of said posts for securing said deck sections together to form a modular pallet wherein any one of said pallet members defining a corner of either of said deck sections maybe replaced by an identical pallet member to form said pallet.

* * * * *